US005251545A

United States Patent [19]

Wetzel

[11] Patent Number: 5,251,545

[45] Date of Patent: Oct. 12, 1993

[54] METHOD FOR SLIP REGULATION OF A PELLET MILL AND APPARATUS FOR CARRYING OUT THE PROCESS

[75] Inventor: Willi Wetzel, Uzwil, Switzerland

[73] Assignee: Bühler AG, Uzwil, Switzerland

[21] Appl. No.: 906,158

[22] Filed: Jun. 29, 1992

Related U.S. Application Data

[62] Division of Ser. No. 733,216, Jul. 19, 1991, Pat. No. 5,152,215.

[30] Foreign Application Priority Data

Aug. 20, 1990 [CH] Switzerland ..... 02697/90

[51] Int. Cl.[5] ..... B30B 11/22

[52] U.S. Cl. ..... 100/41; 100/35; 100/45; 100/47; 100/905; 100/157; 100/99; 425/DIG. 230

[58] Field of Search ..... 100/35, 47, 41, 99, 100/45, 157, 905; 425/331, DIG. 230, 150, 145, 135; 264/40.1, 40.2, 40.7, 140, 142

[56] References Cited

U.S. PATENT DOCUMENTS

| | | | |
|---|---|---|---|
| 3,932,736 | 1/1976 | Zarow et al. | 425/DIG. 230 |
| 4,238,432 | 12/1980 | Henderson et al. | 264/40.7 |
| 4,463,430 | 7/1984 | Volk, Jr. et al. | 425/DIG. 230 |
| 4,711,622 | 12/1987 | Schaffner | 425/DIG. 230 |
| 4,770,621 | 9/1988 | Groebli et al. | 425/DIG. 230 |
| 4,838,779 | 6/1989 | Vries | 425/DIG. 230 |
| 4,861,529 | 8/1989 | Groebli et al. | 264/40.1 |

FOREIGN PATENT DOCUMENTS

| | | | |
|---|---|---|---|
| 0231764 | 8/1987 | European Pat. Off. . | |
| 3806945 | 9/1989 | Fed. Rep. of Germany . | |
| 3816842 | 11/1989 | Fed. Rep. of Germany . | |
| 2341429 | 9/1977 | France . | |
| 1526703 | 9/1978 | United Kingdom | 100/45 |

OTHER PUBLICATIONS

Journal "Electronic" 24/18 Nov. 1986 p. 112.

*Primary Examiner*—Philip R. Coe
*Assistant Examiner*—Reginald L. Alexander
*Attorney, Agent, or Firm*—Martin A. Farber

[57] ABSTRACT

A pellet mill (1) is provided with a control unit with the help of which a desired value of press roll slippage, e.g. zero or a pre-selectable peak value can be maintained. For this purpose, the pellet mill (1) comprises a first measuring unit (27, 28) for measuring the circumferential speed of the perforated die (8) as well as a second measuring unit (23, 24) for measuring the circumferential speed of the press rolls (11, 12). In a comparator (30, 31), the two circumferential speeds are compared and on exceeding a pre-selectable peak value for the difference of the two measured values, a slip signal is created by means of which the mill drive, and/or the supply of basic material to be formed is influenced in such a manner that the slippage will be prevented.

18 Claims, 2 Drawing Sheets

METHOD FOR SLIP REGULATION OF A PELLET MILL AND APPARATUS FOR CARRYING OUT THE PROCESS

RELATED APPLICATION

This application is a division of my co-pending application Ser. No. 07/733,216 now U.S. Pat. No. 5,152,215 Jul. 19, 1991.

FIELD OF THE INVENTION

The invention relates to a method for the operation of a feed mill with at least one perforated die and at least one press roll cooperating with the respective perforated die, on the basis of which an adjustment is effected.

In pellet mills, and particularly in feed pellet mills, there are, in principal, two embodiments, that is those with a flat, about circular perforated die on which edge-runner rolls run off as the press rolls, and pellet mills with an annular pelleting die. Thereby it is known that either the rolls or the die can be driven; mostly, in the case of pelleting dies, it will be the latter, in flat dies it will be the rolls. Between the rolls and the respective die the basic material for the feed pellets is supplied in the form of a mass formed according to the respective recipe. In general, this mass has slip producing characteristics. Since a certain crushing effect, which can improve the pellet quality, is often desired, a certain amount of slippage, i.e. of difference of speed between the respective roll and die, may be admissible. If, however, the slippage becomes too large, the whole mass is piling up in front of the respective roll, which may cause the clogging of the whole mill.

BACKGROUND OF THE INVENTION

The British patent application 1 526 703 describes a press control for a radial feed pellet mill, in which the speed of the extruding die is controlled as a function of the counter-torque in such a way that the installation is utilized in the best possible way.

In this installation, the control works as follows:

With the die driven, the rotating speed is regulated by a torque converter in such a way that, with respect to the most economic operating mode, it is optimally adapted to the counter-torque with the throughput taken into account. With a constant supply of raw material and with a high counter-torque, the speed, by way of example, is being kept constant until the counter-torque exceeds the maximum driving moment. Thereupon, the driving speed naturally decreases with the counter-torque keeping on increasing, and only on falling below a certain minimum speed is the supply of raw material reduced.

This control cannot intervene to prevent slippage, since the rotating speed of the rolls is not taken into account and is not compared with the speed of the die to detect slippage.

The DE-OS 38 06 945 reveals an edge-runner mill in which the die and the pan rolls or the motion of rotation of the pan head and the revolution of the pan rolls are driven independently of each other, so that a preselected relative speed between the die and the surface of the pan rolls is reached at a point located nearest to the die.

Such a mill has no control of slippage, but a preselectable slip setting.

SUMMARY OF THE INVENTION

It is an object of the present invention to better cope with the slippage phenomenon described above.

This is achieved according to the invention by a method by means of which an adjustment can be effected which alters the slippage between perforated die and press roll, the gap between these two parts and/or the mass of material supplied.

A further object is to provide an apparatus in which by means of at least one press roll a rotation running off on a perforated die is effected, with either the perforated die or the press roll being driven directly, and with the motion of that part driven directly being transferable to the other, indirectly driven part, which is brought about by friction on a basic material that is to be pressed through holes in the perforated die with the help of the press rolls.

Such an apparatus, according to the present invention, comprises a switching arrangement of a first measuring unit for measuring the speed of the part which is directly driven, as well as a second measuring unit for measuring the speed of the part driven by friction, as well as a comparator by means of which the measured values of the first and second measuring unit can be compared and on the basis of which a signal is created by which at least one final control element, that is the driving speed of the driven part, and/or the supply of the basic material, and/or the distance of at least one press roll to the perforated die, can be adjusted.

Pellet mills are known which have only one single press roll. This arrangement is mostly chosen for the reason that in such a case this press roll may have a relatively large diameter, which results in a narrow entering angle and an improved drawing in of the raw material into the gap between press roll and die. Owing to the unidirectional forces thereby occurring, at least two press rolls are used much more frequently. In such a case, each of the two press rolls may be subjected to a larger or smaller slippage, with the slippage values probably differing from one another. In principle, it would be conceivable in such a case to unite the slippage signals of all the press rolls in a mixer stage. However, a good functioning is not ensured thereby, since a certain slippage may be admissible under certain circumstances. Therefore, within the scope of the invention, it is preferred if only the signal corresponding to the greatest slippage (and in the case of an allowable slippage: only the greatest signal exceeding the threshold of admissibility) is employed for the control. For this purpose, the outlets of the respective comparator are connected to a threshold detector, which, for the control of the installation, transmits only those signals exceeding a threshold value. Such threshold detectors have already become known in various embodiments, and, for example, such a device could be applied as it was described in the journal "Elektronik" of 24/28th November 1986, p. 112.

It has already been mentioned that in many cases a certain, not too large a slippage, may even be desirable. In such a case it is advantageous when the output signal of the respective comparator is compared to a threshold detector with an adjustable threshold value, or desired value, respectively, with a change of the driving speed of the pellet mill in the sense of a decrease of the difference of speed being initiated only when this pre-selectable threshold value is exceeded.

If provision has been made for such a threshold value, the first transgression of this threshold value means: "Attention! Danger of slippage!" It is true that the press roll may then bite catch again, so that the slippage value falls below the threshold value for a short time. In such situations, it is advantageous to decrease the threshold value after its first transgression within a given period, thus increasing the sensitivity in order to prevent a squagging of the control. However, there may exist products or situations in which the first occurrence of a slippage signal is not twlling enough yet, so that it is better to wait and see whether the slippage signal repeats itself at least once within a given, if necessary preselectable, period.

If, due to the occurrence of a slippage signal, the speed of the drive unit is changed in the sense of a decrease of the difference of speed, the slippage is thereby prevented, and the slippage signal will disappear at the outlet of the comparator.

Thus, a stable condition is reached satisfying as to slippage behavior, but not necessarily with regard to the productive capacity, or quality, respectively, at least not for long. That is why it is convenient to design a timing circuit, which allows for a change of rotating speed only during a predetermined period, whereas it is switched back to another speed at least approaching that of the normal speed. This may occur in such a manner that the normal speed is first reached stepwise, in order to establish at each increase by a step whether a slippage then occurs again. The predetermined time of the timing circuit does not necessarily have to be a rigid fixed time, but may depend on the size of the deviation. In any case, this has the advantage that the termination of the slippage can be ascertained in a relatively short time, and that it is possible to switch to normal operation again, particularly to a greater speed. In such a case, the combination with the previously mentioned increase in sensitivity after the first occurrence of a slippage within a predetermined period is of special advantage.

It has just been mentioned that the return to normal speed can be carried out in steps. However, it is also possible that, due to a slippage signal, the change of speed is effected in steps, so that at each step the gliding ratios may stabilize again, and then to establish, on the basis of the measurement taken thereupon, whether a further decrease turns out to be necessary. That is to say especially with different masses of feeding stuffs, quite frequently no linear slippage behavior will result, which means that by a stepwise lowering of speed it will be rather possible to make allowance for the respective slippage behavior.

Each time at the beginning of operation of a pellet mill, the conditions determining the slippage will have to come into a balance. This is dependent upon the speed of the driving unit, the mass of the parts of the pellet mill, the recipe of the mixture, its humidity, the gap adjusted between roll and perforated die, but also upon the condition of wear of the pellet mill. Here, there is a certain danger that a normal operating condition cannot be reached within an extended period if at the beginning of operation conditions are created by any of the above-mentioned factors favoring the slippage, whose influence continuously operates the control. It is therefore preferred to interrupt the regulation of the rotating speed for a predetermined period at the start-up of the feed pellet mill, which suffices to stabilize the gliding ratios for the time being.

In an arrangement where both at least one press roll as well as a die is driven, it will be of advantage when the control occurs in a sequential manner. In many a case of the kind described it will be convenient to first regulate the drive of the perforated die and only then—in particular on reaching a limit value—the drive of the press roll. However, for flat dies also an inverted order will do.

It has already been mentioned that it is true that the lowering of the difference of speed eliminates the slippage but that this is also tantamount to a decrease of the throughput capacity if this is done by reducing the driving speed of the perforated die. However, it should be mentioned that the latter means, in particular with pellets of a large diameter, may also contribute to an improvement of quality. All the same, in many cases there will be a limit to the decrease of the rotating speed. In order to enlarge the possibilities of adjustment, the outlet of the comparator may be connected to a selector switch unit by which either the number of revolutions of the pellet mill, and/or the rotating speed of one of the feeders supplying material to the pellet mill can be adapted and/or the gap between roll and die can be made variable (mostly in the sense of a decrease). This switching unit can be designed in such a manner that on reaching the upper limit of the range of control of one of the control units, for example the control unit for the feeder of the feed pellet mill, it switches over to a regulation of the driving unit or vice versa. However, it is prefered to design the switching unit in the form of a processor which, due to the information about the instantaneous operating condition of the feeder, or the driving unit of the feed pellet mill, respectively, calculates with which of these adjustments a lesser decrease of the throughput capacity can be achieved. Further, the said switching unit can also be employed for combining and thus optimizing the different behavior of the control of the feeder and that of the driving unit of the pellet mill, or the adjustment of the press roll, respectively. For one has to bear in mind that a control of the feeder can take effect only after a certain period, whereas an intervention on the side of the mill driving unit or on the adjustment of the press roll acts relatively quickly. If these two ways of control are combined, a clogging of the press is excluded by the fact that the feed control responds simultaneously with one of the two other ways of control (or all three of them) as soon as slippage occurs, with the other control unit being switched off after the lapse of this time according to the time constant.

A further advantageous manner of proceeding regarding the control results from the combination with an adjustment of the distance of the respective press roll from the die, that is in dependency upon the gap size. Here, explicit reference is made to the EP-OS 231 764 and its FIG. 8 corresponding to Groebli U.S. Pat. Nos. 4,770,621 and 4,861,529, where an extremely sophisticated control manner is shown and described on the basis of said FIG. 8. Therefore, the whole contents of the foregoing U.S. Patents are incorporated herein by reference. For it is a fact that the draw-in conditions for the raw material change according to the entering angle but also in accord with the gap size. According to the definition of "The Swiss Institute of Feed Technology" the entering angle is formed by a tangent line each to the roll and the die, which tangent lines intersect a point at which the layer of material contacts the roll (this point lies practically at a die radius running along the axis of the press roll). This means that with a larger gap the draw-in conditions change as well, which increases the danger of slippage. Hence, it is conceivable that the sensitivity of the slip regulation is changed in dependency upon the gap size set by the control of adjustment of the press roll. This may occur by switching the output signal of the comparator to a differentiating stage or, in the manner described above, by a decrease of the threshold value, starting from which the slip regulation responds when this value is exceeded. Another possibility would arise by changing the rotating speed of the feed pellet drive in dependency upon the gap size, which means that the driving speed steadily decreases with an increasing gap size. In each case, it is thus of advantage when the control of the driving speed is linked to the control of the adjustment of the rolls; a measurement of the slippage not being absolutely necessary in the latter case, i.e. this principle can be conveniently applied even independently of a slip control, for example in order to influence the quality of the pellets.

A further possibility of adjustment consists in controlling the decrease of the difference of speed of the driving unit in dependency upon an increase of the current consumption of the driving motor. That is to say an increase of the current consumption means a danger of clogging in most cases, which can be obviated by adjusting the difference of speed, for example by decreasing the driving speed.

In the previously mentioned EP-OS 231 764 one also finds a description of the possibility of adapting the control to the condition of wear of press roll and/or die. Since, as has been shown already, the wear is also significant for the slippage, it may be advantageous to provide for an adjustment of the sensitivity of the slip regulation (in the above-mentioned manner) in dependency upon the condition of wear of roll, or die, respectively. Since, in running operation, the probable wear is known in general, the wear can simply be input as a function of time, i.e. with progressing time of use of roll, or form, respectively, an automatic increase in sensitivity of the slip control, e.g. by lowering the threshold value, can be effected.

BRIEF DESCRIPTION OF THE DRAWINGS

Further details are revealed by the following description of embodiments schematically illustrated in the drawing as follows:

FIG. 1 represents the essential parts of a feed pellet mill including a control circuit allowing for several manners of control, to which

DETAILED DESCRIPTION OF THE DRAWINGS

Figure 1:
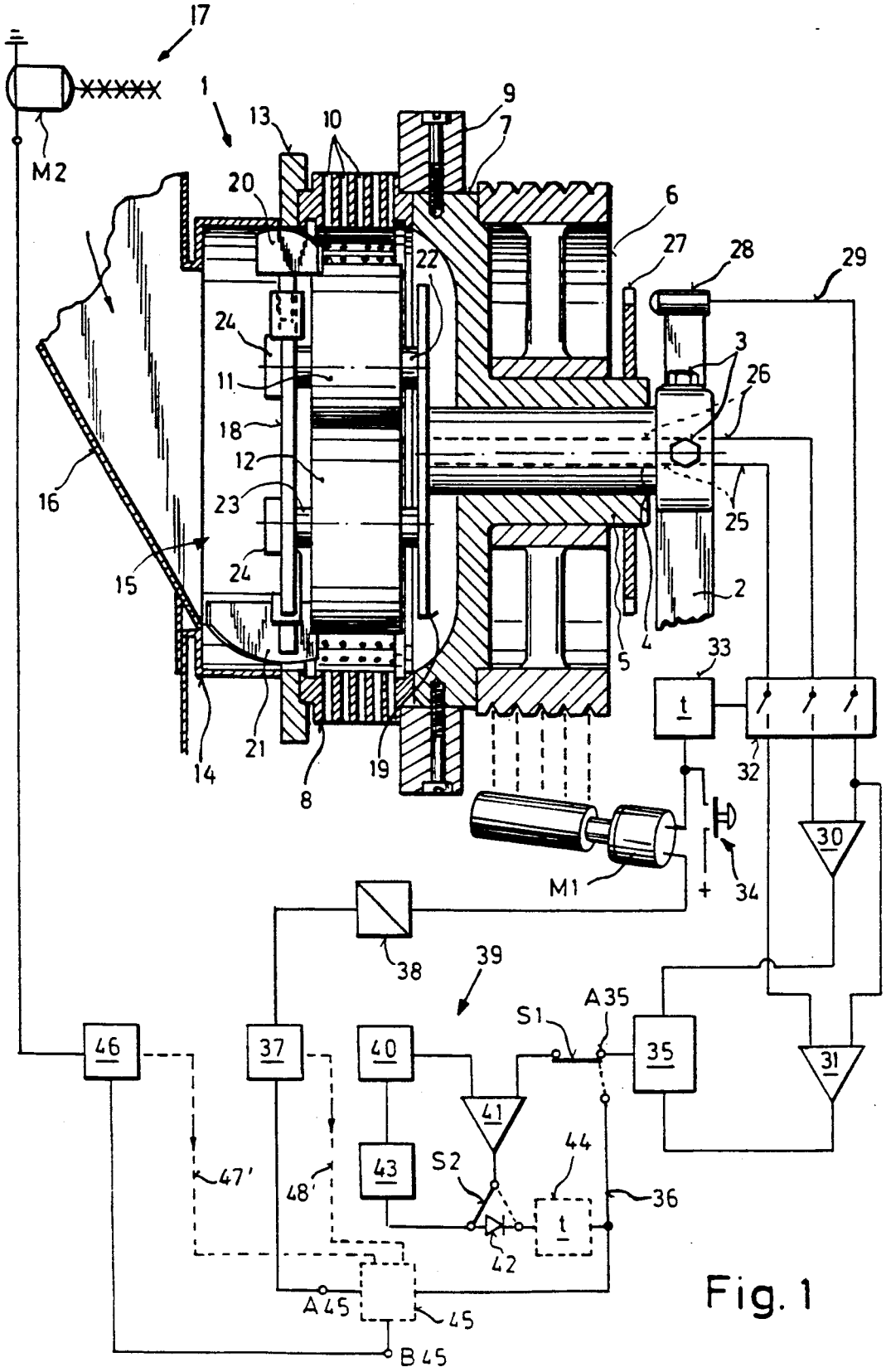

A feed pellet mill 1 not represented in detail has a frame 2, to which an axis 4 is fixed by means of screws 3. On this axis 4 is located the pivot bearing 5 of a die-holder 7 driven by a drive wheel 6, to which a perforated die 8 can be fastened with the help of a fixing device 9.

The perforated die 8 is designed in the form of a pelleting die and, therefore, is provided with holes 10 distributed over its circumference through which the material to be pelleted is pressed by means of two press rolls 11, 12, so that it gets a shape corresponding to the cross-section of the holes 10. A die cover 14 with an opening 15 is linked to a pelleting die 8 by means of a fixing device, into which opening extends a stationary feeding hopper 16 for the raw material. This hopper 16 is charged via a mixing and proportioning device 17 of a known manner, which is schematically indicated.

On its left end—in FIG. 1—the rigid axis 4 supports a mounting plate 19 faced by a mounting plate 18. The shafts 22, 23 of the press rolls 11 and 12 repose on these mounting plates 18, 19. On the side of plate 18, a measuring device for the rotating speed is connected to either shaft 22, or 23, respectively. The material flowing from the hopper into the rotating die cover is fed to the two press rolls 11, 12 via known feed wipers 20, 21.

Each of the two measuring devices of the rotating speed 24 has an output line 25, or 26, respectively, which are led through the hollow axis 4 in the illustrated manner. Also the shafts 22, 23 are suitably hollow for this purpose. Further, a toothed disc is fixed to pivot bearing 5 driven by drive wheel 27 faced by a, for example, inductive sensor 28, so that the rotating speed can be established as a function of the impulse frequency. The transmitter 28 is designed in such a manner that it emits—corresponding to the respective speed—an analog signal to an output line 29. The measuring devices of the rotating speed 24 may be designed similarly.

The lines 25, 26 and 29 are connected to a comparator, which, in the present case, essentially consists of two operational amplifiers 30, 31. In the operational amplifier 30, the output signal in line 26 associated with press roll 11 is compared to the signal of line 29; in the operational amplifier 31, the output signal of line 25 is compared to that of line 29.

On the basis of this comparison, a measure is given for the difference in revolutions, or the slippage of the two press rolls 11 and 12, respectively. It is true that in the present embodiment the drive of the die is shown, but also the individual drive of the press rolls has been proposed already; such a driving unit, alternatively or additionally to the drive of perforated die 8, may be absolutely appropriate for many applications.

It has already been mentioned that at the start of operation the gliding ratios may be different from that of normal operation. In order not to operate the control unnecessarily, which will be described later on, it may be useful to provide a switching arrangement 32 within the path of the lines 25, 26 and 29, which is controlled by a timing member 33. If motor M1 for the drive of wheel 6 of the feed pellet mill is switched on by closing a main switch 34, timing member 33 will be switched on simultaneously, operating the switching arrangement 32 by switching it on only after a predetermined start-up period. Only then are lines 25, 26 and 29 connected to comparator 30, 31. Instead of using a mere timing member, the output signal in line 29 may also be used to allow for slip regulation only on reaching a stable rated speed, however, a timing member 33 will be preferred in general.

The output signal of comparator 30, 31 may be led to a mixer stage, for example an adding stage in order to derive a control signal for motor M1. Still it is preferred if the output signals of the two operational amplifiers 30, 31 are led to a peak value detector or extreme value selector 35, which may be designed in the known manner. This peak value detector transmits only that of the two signals at its output A35 which corresponds to a larger slippage. If more than two press rolls are used, a number of inputs corresponding to the number of press rolls will have to be provided on detector 35. Depending on the kind of circuitry, negative difference values may result in the case of larger slippages, in which case a minimum selector may be employed, so that, generally speaking, an extreme value selector will be used.

At output A35, a selector switch unit S1 is provided, which, in the position represented with broken lines, is directly connected to a line 36 leading to a control switch 37 for the control of a frequency converter 38 for motor M1. Alternatively, switch S1 in its position represented with full lines can operate a threshold switch 39, for instance consisting of a setting means 40 which determines the threshold value, and a postponed operational amplifier 41. Thus, it will be ensured that control switch 37, 38 will react only when a certain slippage considered as admissible is exceeded.

The output of the operational amplifier 41 is connected to a selector switch unit S2, which, in its position represented with full lines, is linked on the one hand to line 36 via a valve circuit 42 schematically indicated and, thus, also with motor-control 37, 38, on the other hand, with a stage 43. The setting means determining the threshold value is operated via said stage 43 at the occurence of an output signal of operational amplifier 42 indicating a slippage in the sense of a decrease of the threshold value. Stage 43 is conveniently designed with a timing member limiting the decrease of the threshold value to a predetermined value. If within this period another slip signal occurs, the threshold value will be further reduced, which will lead to an increase in sensitivity.

If, however, selector switch unit S2 is brought to the position represented with broken lines, the output signal of operational amplifier 41 is transmitted directly to line 36. With such an arrangement, valve circuit 42 prevents any effect onto stage 43.

In such a case, two procedures are conceivable: In the first possibility the control switch 37, 38 is influenced by the output signal of the amplifier 41 only until the slippage has again been eliminated by a change of speed of motor M1, e.g. by a decrease of the same. A second possibility exists in inserting a timing member 44 providing for the maintenance of the changed speed, e.g. a lower speed, for a certain time, for which purpose the output signal received by amplifier 41 is stored and is then passed on to control switch 37, 38 within a predetermined, if necessary adjustable, time. Thus, a certain hysteresis is created, which prevents any guagging of the control circuit. At the same time, after termination of its time constant, timing member 44 ensures the return to normal operation, which need not be the case depending on the design of the control circuit.

The control of a driving motor M2 for feeder 17 may also be associated with the slip regulation described up to this moment. Thus, there is the option to use the output signal in line 36 for the control of motor M1 or for the control of motor M2. For this, a selector switch unit may be disposed in line 36 to deliver the output signal to the two outputs A45 and B45. This selector switch unit 45 may be designed as a manually controlled selector switch, e.g. if with certain raw materials a reduction of the mass supplied for decreasing the slippage is not appropriate. Further, selector switch unit 45 may also be linked to feedback lines 47, 48 from a control stage 46 for motor M1, and from a control stage 37 for motor M1, in which cases several operating modes may be applied:

1. Since the raw material coming from mixing and proportioning unit 17 has to cover a certain distance to press rolls 11, 12, control unit 46 works with a great time constant to prevent slippage, which corresponds approximately to a PI characteristic. By comparison, the time constant of the control stage 37 is relatively short, i.e. its controller action corresponds to a PD characteristic. Yet it is propitious to provide a PID characteristic for the slip control, which can be realized by first supplying the control signal from line 36 to the two outputs A45, B45 via selector switch unit 45. Thus, both control stage 37 and control stage 38 will respond. However, the effect of the control via control stage 46 will take a predetermined time, during which time control stage 37 becomes effective. After this time, the signal at output A45 may be switched off, if so desired.

2. A further possibility is to increase the range of control of at least one of the two control stages 37, or 46, respectively, by providing one of them with a signal from line 36 only on reaching the control limit of the other control stage, preferably control stage 46, if the range of control of that control stage first set into operation should not suffice to decrease the slippage.

3. Stage 45 may be designed as a calculator computing on the basis of the signals from feedback lines 47', 48' whether the throughput capacity of the feed pellet mill can be maintained at a higher level by applying a controlling intervention via control stage 37 or control stage 46, whereupon it emits a signal to this stage from line 36.

4. Finally, the slip regulation may be effected also by alternate activation of two of the said control manners, that is the drive control and/or the feed control and/or the adjustment of the gap between the press rolls and the die, until no further slip signal occurs.

Figure 2:
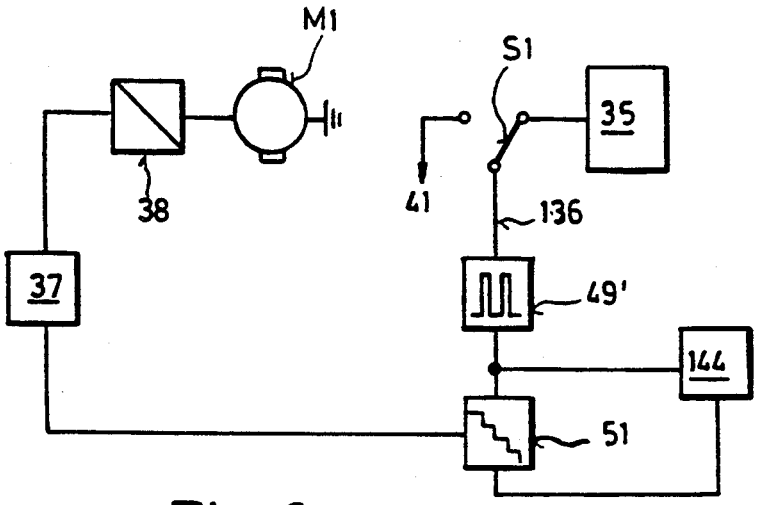
FIGS. 2 to 4 illustrate variants applicable alternatively or cumulatively.

FIG. 2 shows a modified arrangement, with the selector switch unit S1 again having two positions, but which, according to a modification, may have a third position which could be connected to line 36 of FIG. 1. In the position of selector switch unit S1 represented with full lines, it is linked to a line 136 putting into operation a start-stop generator 49', which runs relatively slowly. A predetermined number of impulses are emitted by this start-stop generator 49' at relatively long intervals, which impulses are then passed to a sawtooth generator 51. Sawtooth generator 51 gradually lowers its output signal at each impulse of start-stop generator 49, which results in a stepwise reduction of the rotating speed of motor M1 via motor control unit 37, 38. If at the output of peak value detector 35 the slip signal still remains, start-stop generator 49 will decrease the speed via sawtooth generator 51 down to the lower limit. However, if this should cause the cessation of the slippage already after the first stage or after only a few initial stages, the start-stop generator will be interrupted by a disappearance of the slip signal supplied via line 136, with no further decrease of the speed occurring.

For this, it is advantageous to join a time-determining stage 144 similar to timing member 44 (FIG. 1) to the output of the start-stop generator. As long as impulses from generator 49' are coming in intervals, they will act in the manner of a reset-signal onto timing member 144, i.e. its adjusted time begins running anew at each new impulse. If, however, the impulses from generator 49' stop, timing member 144 will make provision—via its output connected to sawtooth generator 51—for the sawtooth generator to return to its uppermost stage, so that motor M1 keeps on running at normal speed.

Figure 3:
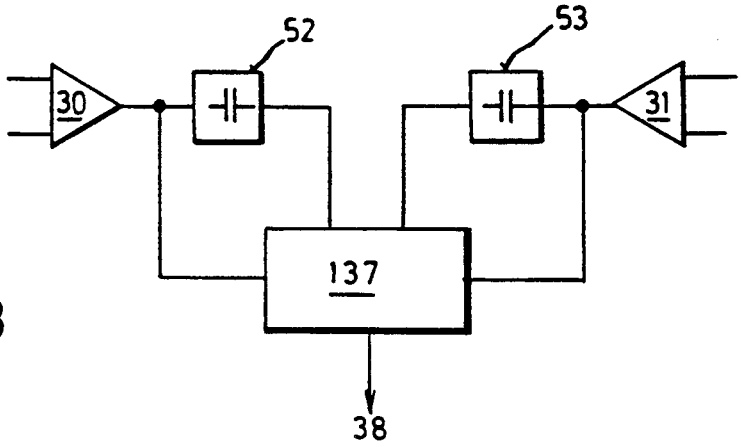

According to FIG. 3, the outputs of the differential amplifiers 30, 31 forming the comparator are directly connected to a control stage corresponding to stage 37 of FIG. 1. This control stage 137 may be designed as a microprocessor choosing itself the appropriate signal in each case, or determining the peak value, respectively. Yet it is also possible to put a differentiating stage 52, or 53, respectively, at the output of the amplifiers 30, 31, on the basis of which it can be ascertained whether, by means of differentiating the slip signal, it is in the increase or decrease. Thereby, a slippage can be prevented quite early already, if desired. Nevertheless, it is advantageous for the microprocessor to receive both the differentiated signals and the difference signal of the slip signals coming from the amplifiers 30, 31, since with a great slippage on one of the two press rolls 11, 12 (FIG. 12), it does not really matter whether the slippage on the other press roll—although still being low enough—is increasing according to the output signal from differentiating stage 52 or 53. This, therefore, means that the microprocessor 137 chooses from the four signals received the most appropriate one to serve the purpose of regulating the slippage. That is, if the slippage is low as such on one of the two press rolls 11, 12, but the differentiated signal from one of the stages 52 or 53 shows an increase of the slippage, the microprocessor will take this signal into account in order to oppose an increase of the slippage at an early time. From this it follows that the amplifiers 30, 31, if desired, need be connected to control stage 137 merely via the differentiating stages 52, 53, since thus a slippage is prevented, as it were, from the very beginning, the direct outputs signals from the amplifiers 30, 31 no longer being necessary at all. However, under conditions where the slippage is slowly increasing, with the differentiating signals thus being very small but long-lasting, it is unadvisable to dispence with direct signals from the amplifiers 30, 31.

It may be mentioned that naturally with the stages 52, 53 a considerable increase in sensitivity of the switching arrangement will be achieved; for this reason, it is conceivable to design a selector switch unit each at the output of the amplifiers 30, 31 in order to change the sensitivity, said selector switch unit selectively passing on the difference signal directly or via the differentiating stages 52, 53. These selector switch units would then have to be actuated by the previously mentioned control stage 43 (FIG. 1).

Figure 4:
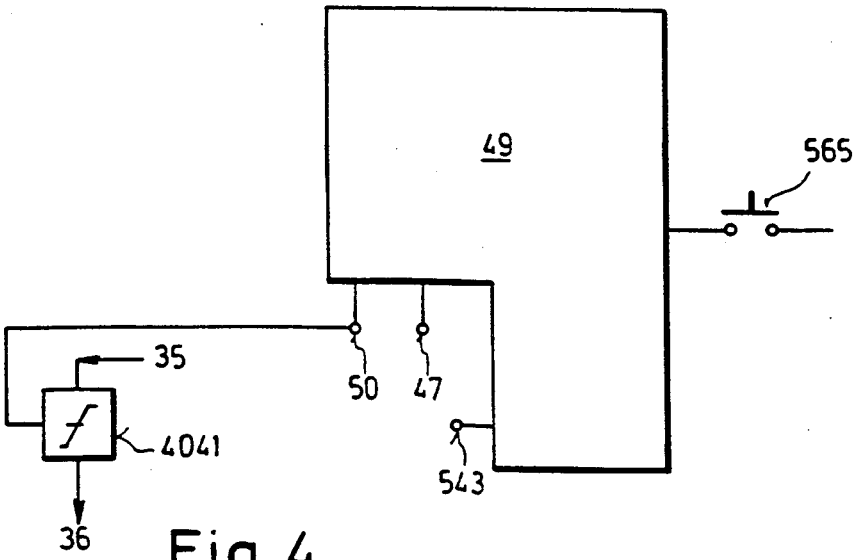

In the case of FIG. 4, a control circuit 49 is provided for the adjustment of the press rolls, as it has been shown and described with the same references in the EP-OS 231 764, FIG. 8. Therefore, one can start from the assumption that this control circuit 49 belongs to the prior art and that, therefore, it need not be described any further. Nevertheless, it may be mentioned that it has an input terminal 47 for the position-measuring signal of the press rolls 11, 12 relative to perforated die 8, i.e. for the size of the gap between rolls and die, and suitably also an entry 543 for a pressure-measuring signal as it has been described in the EP-OS 231 764, a switch 565 for selective consideration of the wear of press rolls 11, 12, or die 8, respectively, as well as a control output 50, via which, according to said EP-OS, an adjustment of the press rolls 11, 12 toward the die or away from it may be effected. Yet, as shown above, it is also possible to join a threshold switch 4041 corresponding to the stages 40 and 41 to this output 50, said threshold switch receiving a signal, by way of example, from threshold detector 35 and passing on a signal to line 36 only if its threshold value is being exceeded. The magnitude of this threshold value depends upon the output signal of control stage 49, which lies on its terminal 50, that is the threshold value of threshold switch 4041 is influenced, in dependency upon the gap size, in such a way that, with the gap between the press rolls and die steadily increasing, the threshold value of threshold switch 4041 is decreased. This is equivalent to a greater sensitivity, or a reduced tolerance for the slippage occuring, respectively. Another possibility, not represented, would be to join a switching arrangement to output 50, which switching arrangement, in the case of a low gap size, passes on the output signal of the differential amplifiers 30, 31 or of the peak value detector 35 directly to control stage 137 (FIG. 3), however, with larger gap sizes between rolls and die, instead of the direct outputs of the operational amplifiers 30, 31 (or peak value detector 35, respectively), the output signal is supplied to a differentiating stage joined to that, such as the differentiating stages 52, 53 of FIG. 3.

It goes without saying that the adjustment of the driving speed does not have to be carried out via a frequency converter 38, and not via the respective motor M1 or M2 either, but that this could also be done with the help of a change gear. Further, with a stationary die, the press rolls could also be driven by means of a common motor, or else independent ones. However, in such a case, a slippage would lead to an acceleration of the press rolls, with a slippage in the arrangement represented causing a retardation of the rotating speed of the press rolls. With such an arrangement, the slip regulation would have to be adapted to this circumstance, and if in the foregoing description the attention has been drawn to the retardation of rotation of the press rolls, this naturally holds true also for an acceleration according to said variant.

It is known to monitor the current consumption of motor M1. This fulfills the purpose of preventing a clogging of the mill. It is possible to obviate this danger by way of changing the rotating speed of motor M1, which is done by a control signal emitted on reaching, or approaching, respectively, a limit value of the current consumption, by which control signal the driving speed is varied particularly in the sense of a reduction.

With regard to the previously mentioned adjustment of the press rolls, it is preferred to choose an arrangement as shown in the EP-OS 231 764, to which explicit reference is made here, in order not to have to describe embodiments which do not belong to the prior art. Such a known arrangement may be chosen instead of (or additionally to) the feed control via motor M1, or the speed control of motor M1, respectively, as suggested in FIG. 4, even though switch 49 may also have a control input, e.g. for readjusting the gap adjustment of the press rolls 11, 12 relative to die 8 in dependency upon the feed and/or driving speed. It may be mentioned that for the determination of the rotating speed, a measurement is not absolutely necessary. For example, drive wheel 6 can be driven by motor M1 free of slippage, so that the motor values themselves can be used to determine the speed, in particular if use is made of an asynchronous motor, or even a synchronous motor, in which cases the line frequency is a direct measure of the driving speed. If the size of the belt slip between motor M1 and drive wheel 6 is known, it would also be possible to use the speed data of motor M1 as a reference.

What is claimed is:

1. A method for operating a pallet mill of the type having at least one perforated die and at least one press roll forming a desire gap between its circumference and the die and cooperating with said die to press materials to be formed into pellets through the perforations of the die by providing a desired supply of material and a desired relative speed between said die said press roll, said method comprising the steps of determining the nominal speed the press roll should have on said die;

determining the actual speed of the press roll;

comparing the normal speed and the actual speed to determine any difference that may occur which constitutes a measure of slippage between said press roll and said die, generating a slippage signal when a difference of speed will occur of an actual valve beyond a predetermined value, and controlling one parameter of said pellet mill being selected from the group of the supply of material, the relative speed of said die and said press roll, and said gap in correspondance with said slippage signal so as to diminish said difference of speed so as to bring it down at least to said predetermined value.

2. A method as claimed in claim 1, wherein at least two press rolls are used, the step of determining the actual speed of the press roll comprising measuring the speed of said press rolls, determining the one with the maximum difference of speed, and generating said slippage signal only from said maximum difference of speed.

3. A method as claimed in claim 1, further comprising the steps of providing an adjustable sensitivity of control, and increasing said sensitivity when a slippage signal occurs within a period of predetermined length.

4. A method as claimed in claim 3, wherein said sensitivity is increased after said slippage signal has occurred for the first time within said period.

5. A method as claimed in claim 3, wherein said predetermined length is selectable.

6. A method as claimed in claim 3, wherein said step of increasing the sensitivity is effected by diminishing said predetermined value.

7. A method as claimed in claim 1, wherein controlling is effected in individual steps allowing a stabilization of slippage conditions after each step.

8. A method as claimed in claim 1, wherein said step of controlling is suppressed during a predetermined period each time after said pellet mill has begun to operate.

9. A method as claimed in claim 1, wherein said step of controlling is done for a predetermined period, then allowing the pellet mill to return to its desired way of operation.

10. A method as claimed in claim 9, wherein said returning step is effected in individual steps.

11. A method as claimed in claim 9, wherein the length of said predetermined period is determined by the amount of said difference.

12. A method as claimed in claim 1, wherein at least a first one and a second one of said parameters are controlled in such a manner that said second parameter is controlled when said difference of speed cannot be brought down at least to said predetermined value by merely controlling said first parameter.

13. A method as claimed in claim 12, wherein said first parameter is the supply of material, which involves a predetermined time delay of the control, and said second parameter being controlled simultaneously with said first parameter when said slippage signal occurs, but the control of the second parameter being terminated at latest after said predetermined time delay.

14. A method as claimed in claim 12, wherein said first parameter is controlled until it cannot be varied any further, after which said second parameter is controlled.

15. A method as claimed in claim 1, further comprising the steps of providing an adjustable sensitivity of control, determining wear occurring on at least one of said press roll and die, and increasing said sensitivity with increasing wear.

16. A method as claimed in claim 15, wherein said step of determining wear is effected by determining the time of operation of at least one of said die and press roll corresponding to a certain wear to be expected.

17. A method as claimed in claim 15, wherein said step of increasing the sensitivity is effected by providing a predetermined threshold value for said slippage signal a and reducing said threshold value.

18. A method for operating a pellet mill of the type having at least one perforated die and at least one press roll forming a desired gap between its circumference and the die and cooperating with said die to press material to be formed into pellets through the perforations of the die by providing a desired supply of material and a desired relative speed between said die and said press roll, said method comprising the step of controlling at least said gap and said relative speed of said die and said press roll, said relative speed being reduced with increasing gap.

* * * * *